United States Patent [19]

Denlinger et al.

[11] Patent Number: 5,071,369

[45] Date of Patent: Dec. 10, 1991

[54] ELECTRICAL CONNECTOR HAVING A TERMINAL POSITION ASSURANCE MEMBER

[75] Inventors: Keith R. Denlinger, Lancaster; Richard W. Gryzbowski, Lebanon; John M. Myer, Millersville, all of Pa.

[73] Assignee: AMP Incorporated, Harrisburg, Pa.

[21] Appl. No.: 624,802

[22] Filed: Dec. 5, 1990

[51] Int. Cl.[5] ..... H01R 13/424

[52] U.S. Cl. ..... 439/595; 439/598; 439/752

[58] Field of Search ..... 439/594, 595, 598, 752

[56] References Cited

U.S. PATENT DOCUMENTS

| | | | |
|---|---|---|---|
| 4,343,523 | 8/1982 | Cairns et al. | 339/59 M |
| 4,557,542 | 12/1985 | Coller et al. | 439/595 |
| 4,708,662 | 11/1987 | Klein | 439/353 |
| 4,714,437 | 12/1987 | Dyki | 439/595 |
| 4,749,372 | 6/1988 | Betsui | 439/587 |
| 4,776,813 | 10/1988 | Wilson et al. | 439/587 |
| 4,806,123 | 2/1989 | Konishi et al. | 439/595 |
| 4,940,398 | 8/1990 | Takenouchi et al. | 439/752 |
| 4,971,580 | 11/1990 | Ward et al. | 439/595 |
| 4,973,268 | 11/1990 | Smith et al. | 439/595 |

*Primary Examiner*—Paula A. Bradley

*Attorney, Agent, or Firm*—Allan B. Osborne

[57] ABSTRACT

A connector (10) having a terminal position assurance member (12) for insuring the proper positioning of terminals (18) in the connector housing (14) is disclosed. The assurance member (12) in cooperation with cantilever beams (30) located in the terminal cavities (24) cannot be fully seated in the housing (14) if improperly positioned terminals (18) are holding the beams (30) in a blocking position relative to the assurance member (12). The assurance member (12) further includes latching arms (60) which must be depressed before the assurance member (12) can be fully seated.

2 Claims, 5 Drawing Sheets

ELECTRICAL CONNECTOR HAVING A TERMINAL POSITION ASSURANCE MEMBER

FIELD OF THE INVENTION

This invention relates to electrical connectors of the type having a terminal position assurance and locking member which is assembled to the connector housing for the purpose of assuring that the terminals have been properly and completely inserted into the housing and for locking the terminals in their inserted positions.

BACKGROUND OF THE INVENTION

A known type of electrical connector assembly comprises an insulating housing having contact terminals therein and having a separate locking or terminal position assurance member which is inserted into the mating face of the housing after the terminals have been inserted. U.S. Pat. No. 4,557,542 shows a connector housing which contains quick disconnect type terminal which have a generally rectangular cross-section and which are intended to be mated with terminal tabs. A terminal locking and position assurance member is inserted into the mating face of the housing after the terminals have themselves been inserted, but the assurance or locking member cannot be inserted into the housing unless the terminals have been fully and properly inserted. The locking member engages latches and prevents flexure of these latches so that the interengaging portions of the latches and the terminals are locked in their interengaged position. Terminal position assurance and locking member thus overcomes the problems of incomplete terminal insertion into the connector housing and insufficiently secure retention of the terminals in the housing after insertion, two problems which have in the past plagued some multi-contact electrical connectors.

Another known connector, disclosed in U.S. patent application Ser. No. 07/500,982 filed Mar. 28, 1990 comprises an electrical connector housing assembly which is intended to receive a contact terminal, the housing assembly comprising a housing body and a terminal locking and terminal position assurance member. The housing body has a mating face and a rear terminal receiving face which is directed oppositely with respect to the mating face. A terminal receiving passageway extends through the housing body from the rear face towards the mating face and the terminal locking member is insertible into the housing body from the mating face. The housing assembly is characterized in that the passageway has internal wall portions which have a fixed shoulder thereon that is directed towards the mating face. A cantilever beam is provided in the passageway, the beam having a fixed shoulder. The beam has a moveable shoulder thereon adjacent to its free end which is directed towards the mating face and the beam is flexible laterally of its length away from the fixed shoulder. The terminal locking member has a beam engaging portion which is positioned adjacent to the free end of the beam when the locking member is inserted into the body portion. The locking member is insertible only when the beam is in its unflexed position. A contact terminal having retaining portions thereon which are engageable with the fixed and moveable shoulders can thus be inserted into the passageway from the rear face until the retaining portions are beyond the shoulders. The cantilever beam is temporarily flexed during movement of the terminal past the shoulders and after insertion of the terminal, the locking member can be inserted into the mating face. The fixed shoulder is preferably on an ear which is integral with, and extends from, the internal wall portions of the passageway. The beam engaging portion of the locking member is moveable against the beam when the beam is in its flexed condition thereby preventing insertion of the locking member into the housing body so that the locking member can be inserted into the housing body only if the terminal is fully inserted and cannot be inserted into the housing body if the terminal is only partially inserted. The beam engaging portion is positioned beside, or adjacent to, the cantilever beam after insertion and serves to prevent flexure of the beam when the locking member is inserted whereby the terminal will be locked in the housing assembly. A second passageway may be provided in the housing body which is beside, and parallel to, the first passageway. A second cantilever beam is provided for the second passageway and the two beams are located between, and serve to separate, the two passageways.

It is now proposed to provide a connector wherein the fixed shoulder has been removed and cavity defining partitions provide an anti-overstress for cantilever beams located in opposite cavities.

SUMMARY OF THE INVENTION

According to the present invention, an electrical connector is provided wherein cavities in a housing are defined by partitions and cantilever beams having a depending boss on one edge extend longitudinally in each cavity. Terminals positioned in the cavities have an annular groove in which the boss is received when the terminal is properly positioned in the cavity. A terminal position assurance member having a finger thereon is inserted into the cavities with the finger being received alongside the beam when the boss is in the groove but abuts the free end of the beam when the boss is not in the groove, thus indicating that the terminal is not properly positioned in the cavity.

DESCRIPTION OF THE INVENTION

Figure 1:
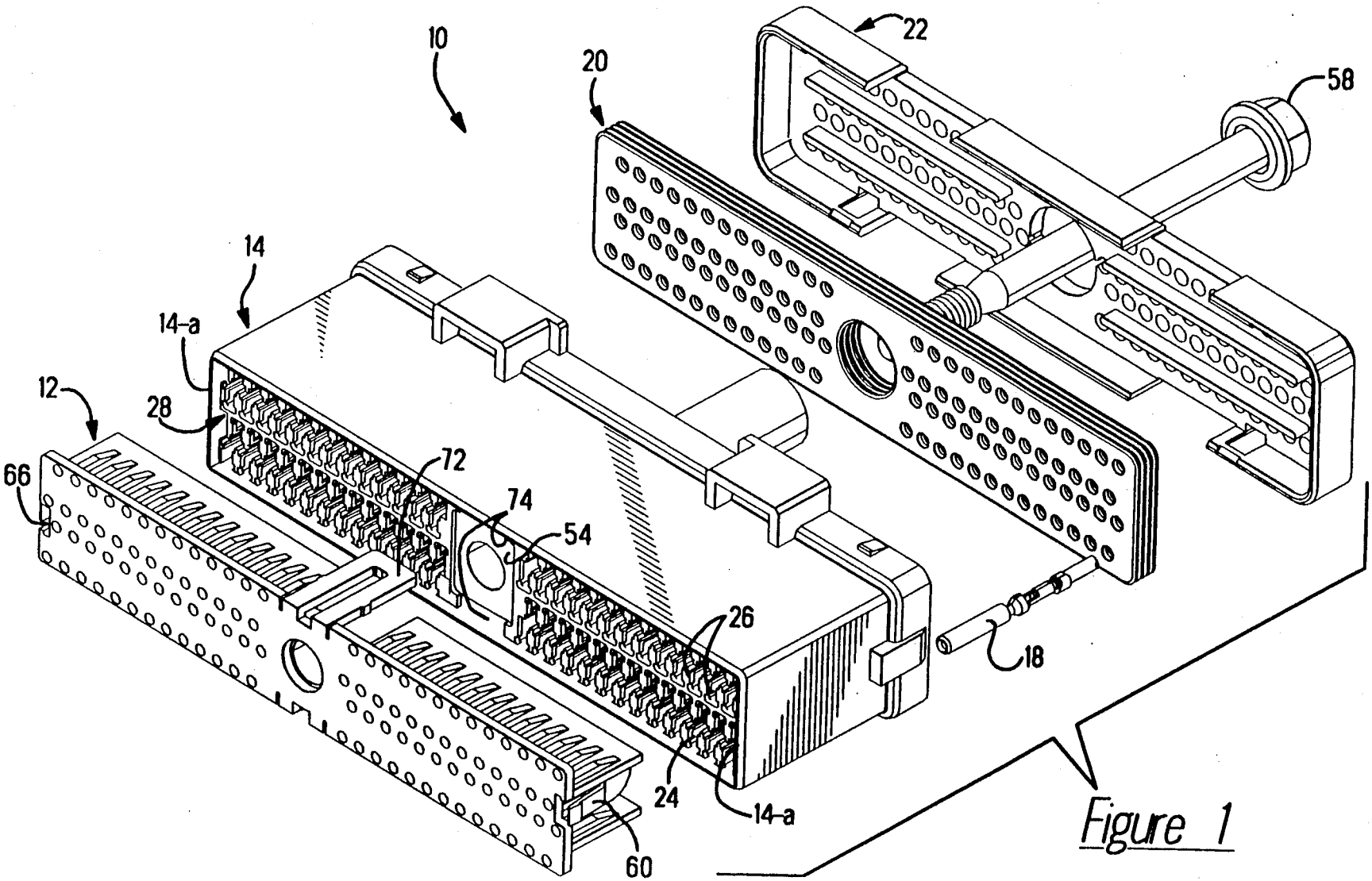
FIG. 1 is a perspective, exploded view of a connector utilizing therein a terminal position assurance member of the present invention.

Connector 10 shown in FIG. 1 includes terminal position assurance member 12 of the present invention, housing 14, socket terminals 18, seal 20 and rear face plate 22.

Housing 14 is provided with four rows of cavities 24 which are defined by partitions 26. Cavities 24 in each set of two rows face each other and are offset laterally so that partitions 26 in one row are on the same center line as the facing cavities 24. This arrangement is provided for a specific purpose to be discussed below. A thin wall 28 separates the two sets of rows. Further, as shown in FIGS. 3-6, a cantilevered socket locking beam 30 extends into each cavity 24 from a shoulder 32 of partition 26.

Partitions 26 extend toward but stop short of entering the facing cavities 24.

Figure 2:
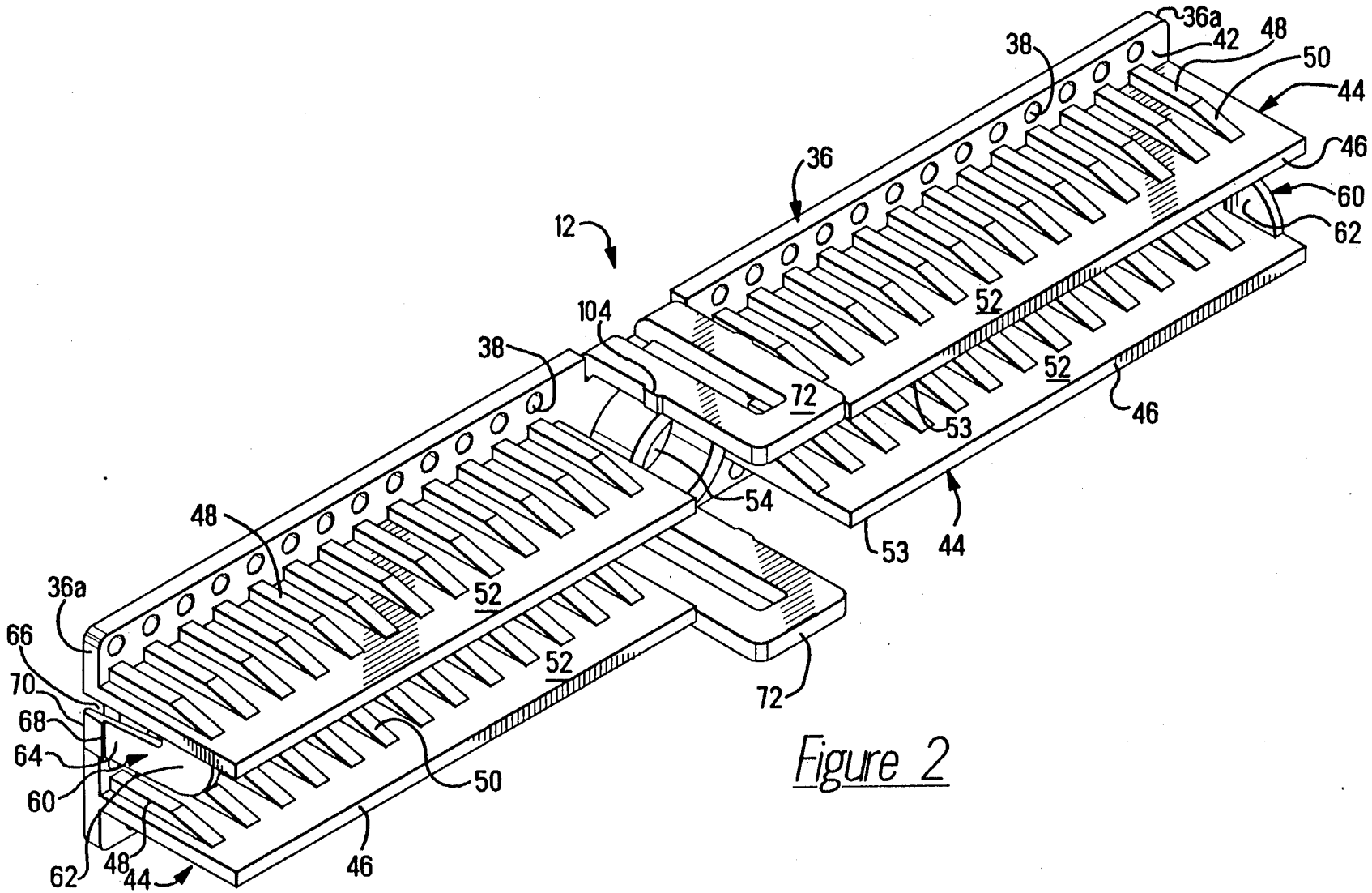
FIG. 2 is an enlarged perspective view of the terminal position assurance member.

Referring now to FIG. 2 as well as FIG. 1, terminal position assurance member 12 includes front plate 36 which has openings 38 therethrough. Openings 38 are arranged in the same pattern as are cavities 24 and are in alignment therewith when member 12 is in place in housing 14.

Projecting outwardly from surface 42 of plate 36 are thin, broad fingers 44 having free ends 46. Inwardly from ends 46 and surface 42, are ribs 48 which are slanted to provide ramps 50. Ribs 48 on surface 52 of fingers 44 are in alignment with openings 38 on the side of surfaces 52 and ribs 48 on opposite surfaces 53 are in alignment with openings 38 adjacent thereto.

As shown in FIG. 2, there are four fingers 44, two on one side of a centrally located hole 54 and the other two on the other side. This arrangement is necessitated by the need for supporting structure 56 in housing 14 for receiving jack screw 58 (FIG. 1) therethrough. Otherwise the fingers 44 would continue across plate surface 42 without interruption.

Member 12 further includes a pair of latching arms 60, one at each side of plate 36. Arms 60 are L-shaped with a short portion 62 attached to a finger 44 and a resilient, elongated portion 64 extending to notches 66 provided in both side edges 36*a*. The resilient elongated portions 64 are formed outwardly of the plane of the sides of plate 36 and a force must be applied to move them into notches 66. Shoulder 68 adjacent free ends 70 of elongated portions 64 face are on the outside surfaces thereof and face housing 14 when member 12 is inserted therein.

As shown, one arm 60 is attached to the lower right finger 44 and the other arm 60 is attached to the upper left finger 44. In both cases, arms 60 occupy the space between fingers 44.

Member 12 further includes a pair of blades 72 which enter slots 74 on opposite sides of supporting structure 54 shown in FIG. 1. Blades 72 in cooperation with locking features (FIGS. 7 & 8) in housing 14 retain member 12 in a pre-assembled or initial position and also in a final position as will be discussed below.

Figure 3:
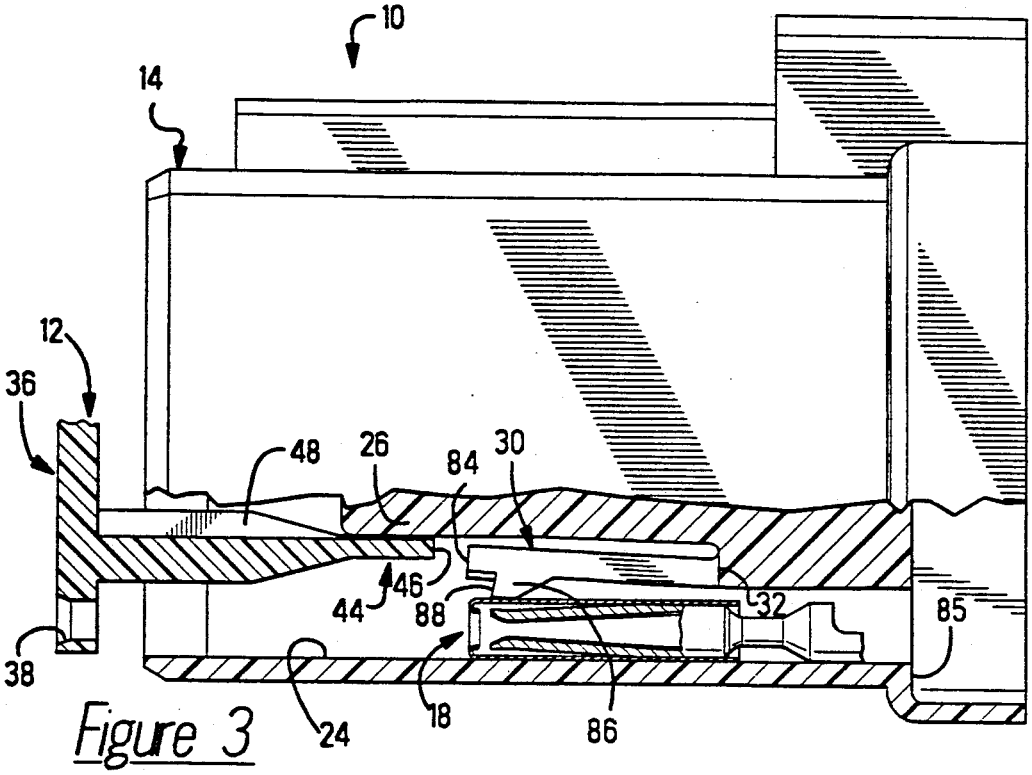
FIGS. 3,4 and 5 are sectioned side views showing the operation of the terminal position assurance feature of the present invention.
Figure 4:
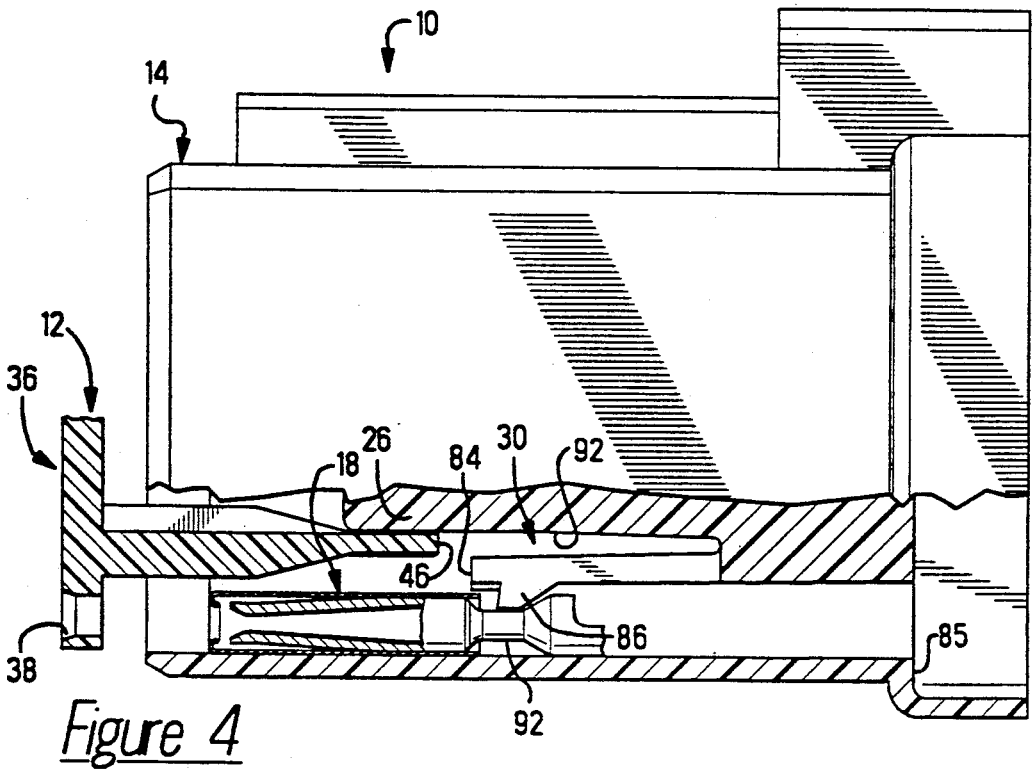
Figure 5:
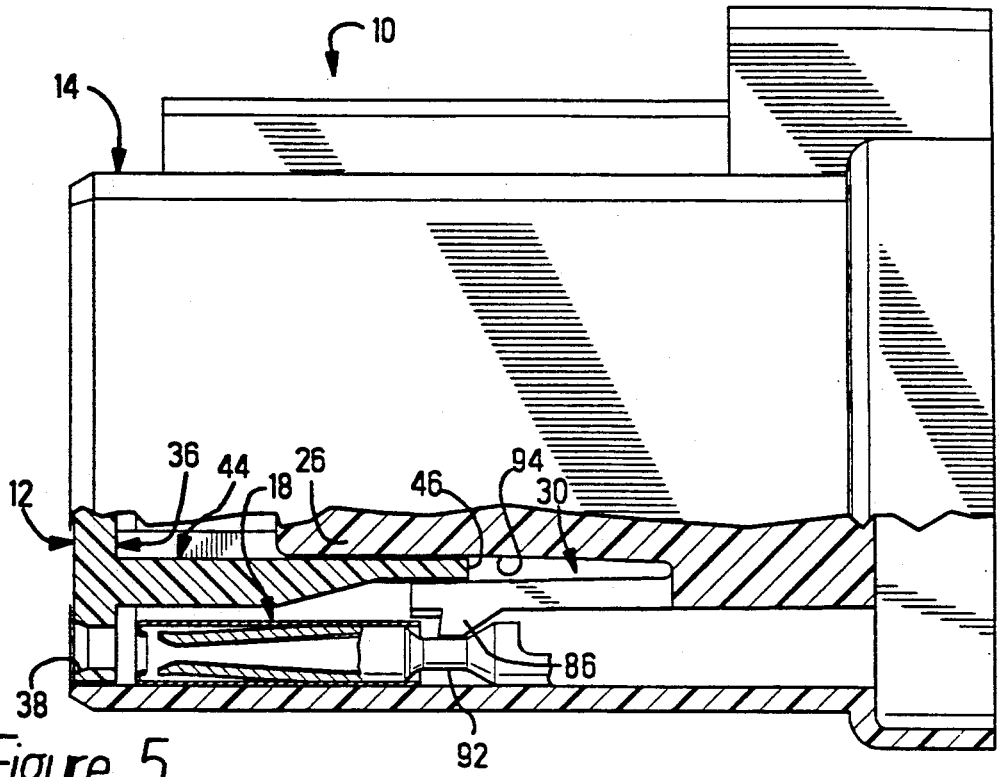

FIGS. 3, 4 and 5 are views of the terminal position assurance feature of member 12. This feature includes fingers 44 which cooperate with the aforementioned cantilever beams 30.

As shown in FIG. 3, beams 30 are attached to partitions 26 and project into respective cavities 24. Adjacent free end 84 of each beam 30 is a boss 86 which defines shoulder 88. As shown, shoulders 88 face towards the front opening of cavities 24.

Socket terminals 18 are inserted into cavities 24 through rear openings in wall 85. Engagement with bosses 86 cams the resilient beams 30 away from terminals 18 and towards partitions 26 as shown in FIG. 3.

As shown in FIG. 4, boss 86 enters annular groove 92 on terminals 18, letting beam 30 return to its original position which is spaced from partition 26 to define space 94 therebetween.

As shown in FIG. 5, member 12 is pushed into housing 14 to a final position wherein fingers 44 enter space 94 therebetween partition 26 and beam 30.

The ability to push member 12 freely to its final position signals the operator that terminals 18 are in the proper position and connector 10 is ready to be mated to a pin connector (not shown).

In addition to providing position assurance, member 12 also locks terminals 18 in position by biasing beams 30 thereagainst and holding bosses 86 in annular grooves 92 so that shoulders 88 abut a wall of grooves 92 to prevent terminal withdrawal.

Figure 6:
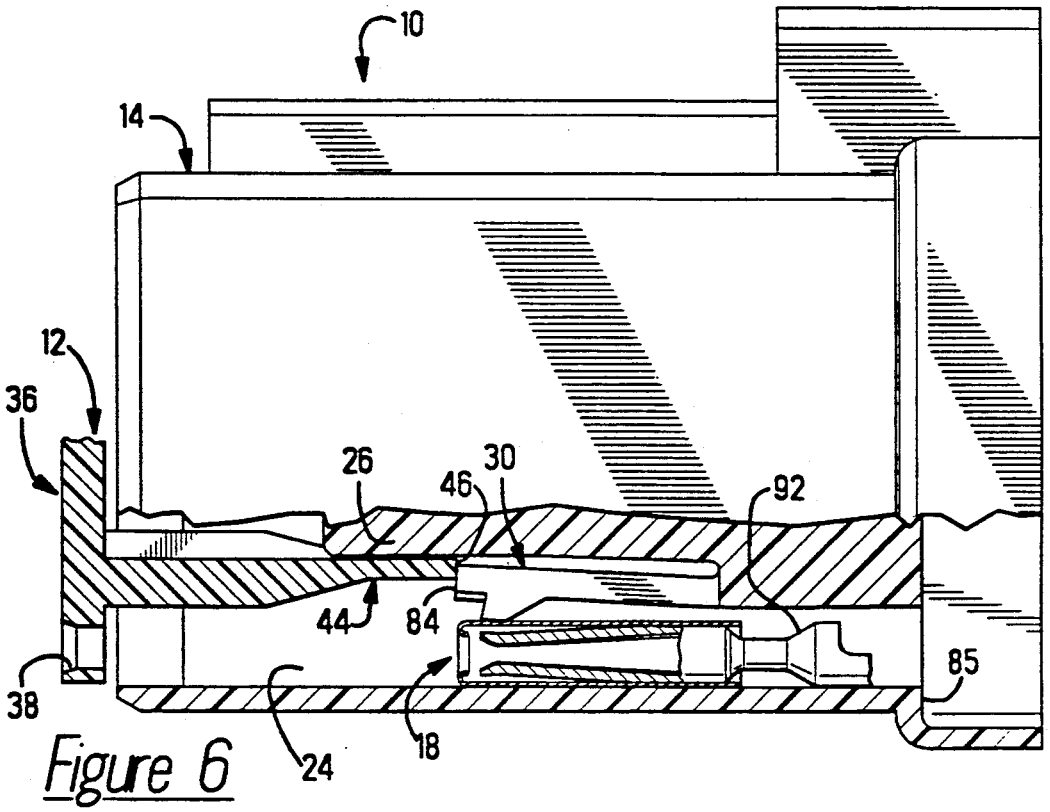
FIG. 6 shows in a sectioned side view the inoperability of the terminal position assurance member due to an incomplete terminal insertion.

In the event one or more terminals 18 are only partially inserted into cavities 24, the condition shown in FIG. 6 occurs; i.e., beam 30 is being biased towards partition 26 by boss 86 riding on terminal 18 and not being in groove 92. As the operator attempts to drive member 12 to its final position, free end 46 of fingers 44 abuts free end 84 of beam 30 which is in space 94, i.e., the space fingers 44 would otherwise enter as shown in FIG. 5.

It is desirable to ship connectors 10 to the end user pre-assembled; i.e., with terminal position assurance member 12 partially inserted into housing 14. The end user inserts terminals 18 into cavities 24 and seats member 12 in its final position shown in FIG. 5. It is also desirable to provide means for latching member 12 in its partially inserted or first position in such a manner that a positive act is required to move it to the final position and so that an accidental force exerted against member 12 will not seat it.

Latching arms 60, in cooperation with blades 72, provide the aforementioned desired characteristics. Cooperating means on blades 72 and in slots 74 retain member 12 in an initial position shown in FIG. 3. In this position, shoulders 68 engage the edges 14-*a* (FIG. 1) of housing 14 and prevent member 12 from being pushed further in. After terminals 18 are loaded into cavities 24, the operator pushes free ends 70 of elongated portions 64 into notches 66 so that shoulders 68 are clear of edges 14-*a* and member 12 can now be fully inserted without the use of force. In other words, to push member 12 to its final position, a deliberate act of pushing latching arms 60 laterally in is required.

The fact that member 12 can be easily inserted to its final position is very desirable because the operator will not be mislead into confusing a force caused by finger 44 engaging a beam 30 with a force required to seat member 12.

Figure 7:
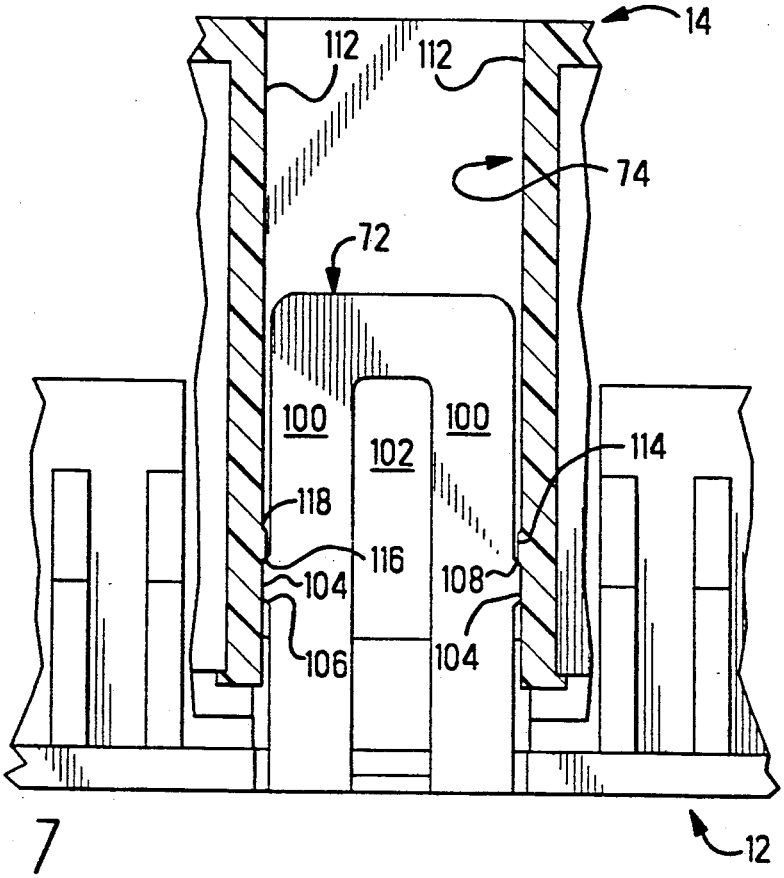
FIG. 7 shows a top plan, partly sectioned view of a locking blade received in a first position in the housing.
Figure 8:
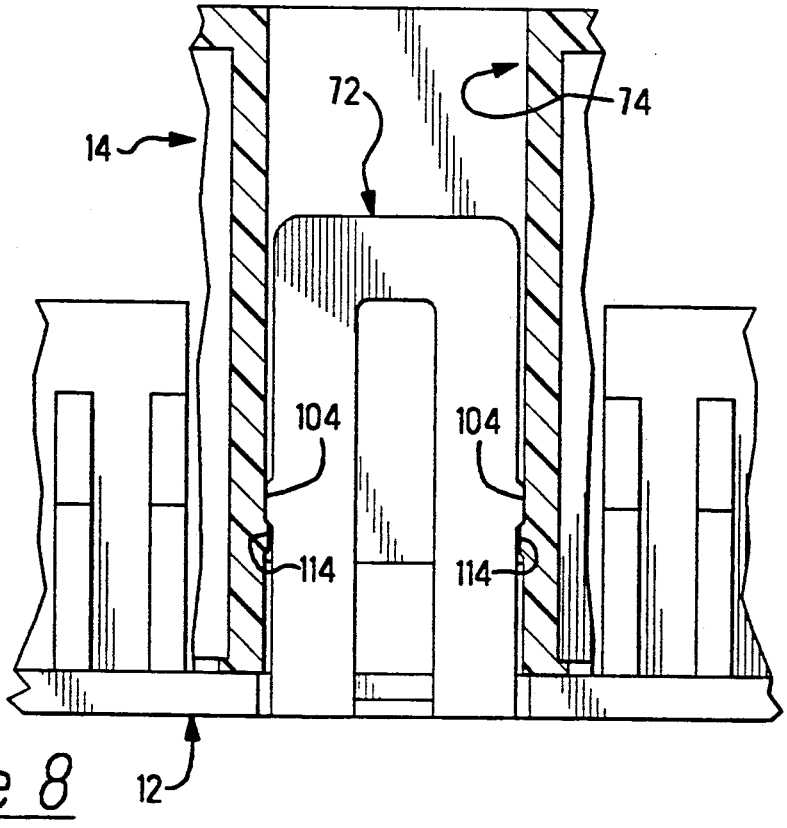
FIG. 8 shows the blade received in a final position.

FIGS. 7 and 8 provide more detail with respect to blades 72 and slots 74. Each blade 72 includes a pair of parallel resilient beams 100 defined by slot 102. Laterally projecting ears 104, provided on the outer edges of each beam 100, define forwardly facing shoulders 106 and rearwardly facing shoulders 108.

Slots 74 are defined by sidewalls 112. Bosses 114 on each sidewall 112 project into slots 74 and include forwardly facing shoulders 116 and rearwardly facing shoulders 118.

The width of blades 72, as measured from the free sides of ears 104, is slightly greater than slots 74 between sidewalls 112. Thus, in inserting blades 72 into slots 74, beams 100 are resiliently deflected towards each other to provide an interference fit.

As shown in FIG. 7, blade 72 has been inserted to an initial position with the rearwardly facing shoulders 108 on ears 104 abutting forwardly facing shoulders 116 on bosses 114.

In FIG. 8, blade 72 is shown in the final position where ears 104 are on the rearward side of bosses 114.

To pass from the initial to the final position, a force must be applied to permit ears 104 to pass inside of bosses 114; i.e., by beams 100 deflecting towards each other. Also, a force must be applied to with draw blades 72 from the final position in slots 74. So that at least the force to drive blades 72 into the final position is not confused with a resistence offered by a finger 44 abutting a beam 30 (FIG. 6), ears 104 and bosses 114 are dimensioned so that the insertion force needed to push blades 72 into the final position is much less than the force required to damage beam 30.

As noted above, partitions 26 and cavities 24 are arranged so that partitions 26 in one row face towards the centerline of cavities 24 in the adjacent row. This arrangement provides a stop for cantilever beams 30. In the event a terminal 18 needs to be withdrawn, a tool (not shown) such as a tiny screwdriver is inserted into cavity 24 (after the withdrawal of member 12) and beam 30 is lifted away to free terminal 18. The beam 30 will engage the free edge of partition 26 before it can be over-stressed and broken.

As can be discerned a terminal position assurance member for a multi-cavity connector housing has been disclosed. The assurance member, cooperating with cantilever beams in the cavities, cannot be inserted fully into the housing if one or more terminals are not fully positioned in the cavities. Further, the assurance member is provided with latching arms which, in cooperation with the housing, must be positively acted upon before the member can be fully seated.

We claim:

1. An electrical connector comprising terminals positioned in cavities in a housing and a terminal position assurance member adapted to assure the positioning of the terminals in the housing, characterized in that the terminal position assurance member includes a front plate with a plurality of broad fingers projecting from a rear surface of said plate for insertion between rows of cavities in a terminal housing and depressible arm at each side of said member, said arms being attached to a finger and projecting towards said front plate with a free end being in alignment with a notch in said plate and having a rearwardly facing shoulder on an outside surface for catching an edge of a side wall on said housing to prevent said member from being fully inserted thereinto.

2. The electrical connector of claim 1 characterised in that said housing includes slots extending thereinto with inwardly projecting bosses on sidewalls defining said slots and said member includes outwardly extending resilient beams for insertion into said slots.

* * * * *